US006010363A

United States Patent [19]

Dobrich et al.

[11] Patent Number: 6,010,363

[45] Date of Patent: Jan. 4, 2000

[54] CONNECTOR ASSEMBLY

[75] Inventors: Paul W. Dobrich, Plano, Ill.; Philippe J. Hennaux, Tamines, Belgium

[73] Assignee: Caterpillar Inc., Peoria, Ill.

[21] Appl. No.: 08/936,413

[22] Filed: Sep. 25, 1997

[51] Int. Cl.[7] ..... H01R 13/73

[52] U.S. Cl. ..... 439/571; 248/224.61; 248/224.51

[58] Field of Search ..... 439/571; 248/224.61, 248/224.51, 229.21, 346.04, 205

[56] References Cited

U.S. PATENT DOCUMENTS

| | | | |
|---|---|---|---|
| 1,845,365 | 2/1932 | Thomson . | |
| 3,365,156 | 1/1968 | Beck | 248/205 |
| 3,576,303 | 4/1971 | Matson | 248/224.61 |
| 4,466,683 | 8/1984 | Ballarini | 439/571 |
| 5,826,845 | 10/1998 | Lounsbury et al. | 248/224.61 |

FOREIGN PATENT DOCUMENTS

| | | | |
|---|---|---|---|
| 240732 | 1/1961 | Australia . | |
| 666048 | 7/1963 | Canada | 173/321 |
| 673285 | 10/1963 | Canada | 317/119 |
| 998731 | 1/1952 | France | 6/12 |
| 716486 | 1/1942 | Germany . | |
| 830813 | 2/1952 | Germany . | |
| 566759 | 1/1945 | United Kingdom . | |
| 1036324 | 7/1966 | United Kingdom | H01R 9/02 |
| 1149372 | 4/1969 | United Kingdom | H01R 9/22 |

*Primary Examiner*—Paula Bradley
*Assistant Examiner*—Katrina Davis
*Attorney, Agent, or Firm*—William C. Perry; Alan J. Hickman

[57] ABSTRACT

During the performance of service on many machines, it is often necessary to remove one component from another necessitating the removal of any wiring clips or harnesses that may be attached thereto. In many instances, removal of these wiring clips creates a laborious and/or an unduly complicated task. The present invention provides a connector assembly that includes a mounting portion that has a groove defined therein that receives a tapered abutment member defined by a clip assembly. The groove has tapered end portions on each end thereof that interact with the tapered abutment member to allow easy and selective removal and assembly of the clip assembly and mounting portion depending on the type of service required.

9 Claims, 3 Drawing Sheets

CONNECTOR ASSEMBLY

TECHNICAL FIELD

This invention relates to a connector assembly and more particularly to a connector assembly for electrical wires that is readily assembled and disassembled from its mounting to a frame member.

BACKGROUND ART

In the automotive and construction industry, the use of electronics has expanded dramatically. Due to the increased use, the wiring of a machine has become more complex, requiring wires to extend to virtually all areas of the machine. The wires must be routed in a manner that will allow service to various components of a machine without breakage of the wires. In order to do this, numerous connectors are positioned in the wires that may be disconnected and reconnected during these times to permit service.

On construction machines in particular, these connectors are typically secured to a portion of the machine frame and a plastic connector assembly is utilized to connect the separate wires or groups of wires. In many cases, a mounting clip is bolted to the frame and the connector assembly is secured in some form to the clip. In some cases, the connector assembly will overlie the clip and prevent removal of the clip without first separating the connector assembly. In the situation wherein it is desirable to remove only the mounting clip, this creates an unnecessary duplication of effort that increases the time required for service. In other instances, the connector assembly is secured or "snapped" into engagement with the mounting clip in a manner that requires a great deal of effort to separate the components once they are engaged. In many instances, the connector is destroyed before the clip can be separated from the mounting bracket.

In each of the instances set forth above, substantial inconvenience or needless destruction of components is experienced for a relatively simple operation. The present invention provides a clip assembly that has a mounting plate that is fastened to a frame in a manner that is readily accessible to release its connection to the frame without disturbing the clip connection. In addition, the clip is connected to the mounting plate in a manner that permits easy assembly and disassembly without destruction of the various components.

The present invention is directed to overcoming one or more of the problems set forth above.

DISCLOSURE OF THE INVENTION

In one aspect of the present invention a connector assembly is provided that includes a base member that has a mounting portion and a receiving portion that is laterally spaced from the mounting portion. The receiving portion defines a pair of angled, outwardly extending flanges. A groove is provided that has a tapered end portion on each end thereof and is positioned between the flanges. A first clip member is also included that has a housing that defines a pair of outwardly extending flanges and a tapered abutment member. The first clip member is adapted for engagement with the base member with the outwardly extending flanges of the first clip member in contact with the outwardly extending flanges of the base member in dovetail relation thereto. Also, the tapered abutment member is engaged with one of the tapered end portions of the groove. This engagement secures the position of the first clip member with respect to the base member.

With a connector assembly as set forth above, the first clip member may remain engaged with the base member while the base member is removed from engagement with a frame member. Alternatively, the clip member may be readily released from engagement with the base member due to the tapered configuration of the respective groove end portions and the abutment member, without having to use excessive force or additional tools.

BEST MODE FOR CARRYING OUT THE INVENTION

Figure 1:
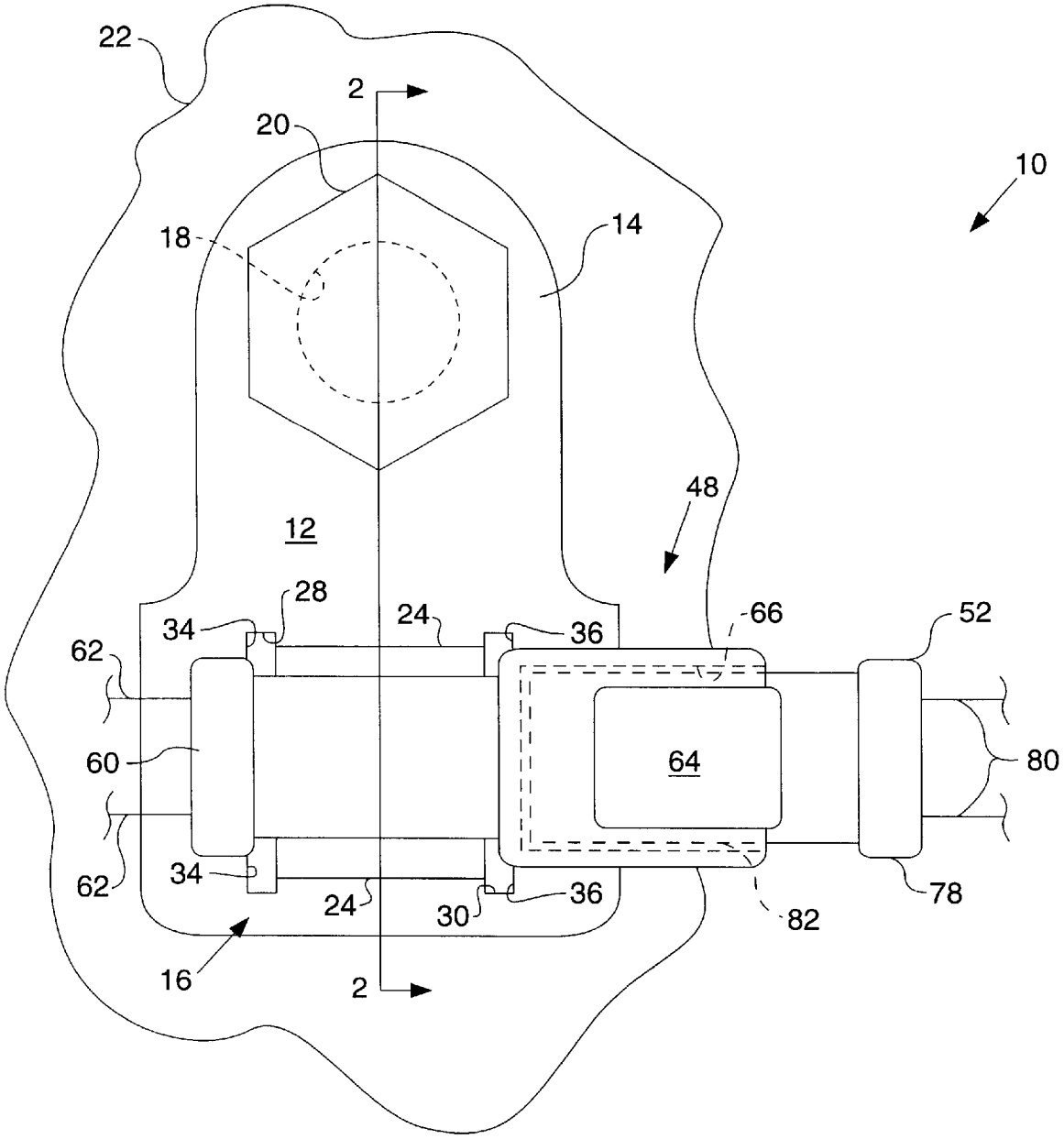
FIG. 1 is a diagrammatic top view of a connector assembly that embodies the principles of the present invention.

Referring to the drawings, it can be seen that a connector assembly, is generally shown at 10. The connector assembly includes a base member 12 that is substantially planar in configuration. The base member defines a mounting portion 14 and a receiving portion 16 that is laterally spaced from the mounting portion. The mounting portion, in turn, defines a mounting bore 18 that is sufficient to receive a threaded fastener, such as a bolt 20 to secure the base member to a frame member 22 (FIG. 1). The receiving portion 16 defines a pair of spaced apart flanges 24 that extend outwardly from the base member 12 at a pre-selected angle with respect thereto. As viewed in FIG. 2, the flanges 24 extend from the base member in an upward direction and are angled inwardly toward one another. A pair of openings 28 and 30 are formed in the base member in the area that is subjacent the angled flanges 24. The openings 28 and 30 are separated from one another by a web portion 32 that is defined in the base member and extends the full length between the openings 28 and 30. The openings are sized to have a pre-selected length "L" and terminate at a vertically directed endwall 34 and 36, on opposing ends thereof, as viewed in FIG. 3 of the drawings. A groove 38 is defined in the web portion 32 and extends substantially the entire length thereof. Each end portion 40 and 42 of the groove terminates in an upwardly tapered or radiused configuration and defines a laterally directed abutment surface 44 at the intersection between the groove and the upper surface 46 of the base member 12.

Figure 2:
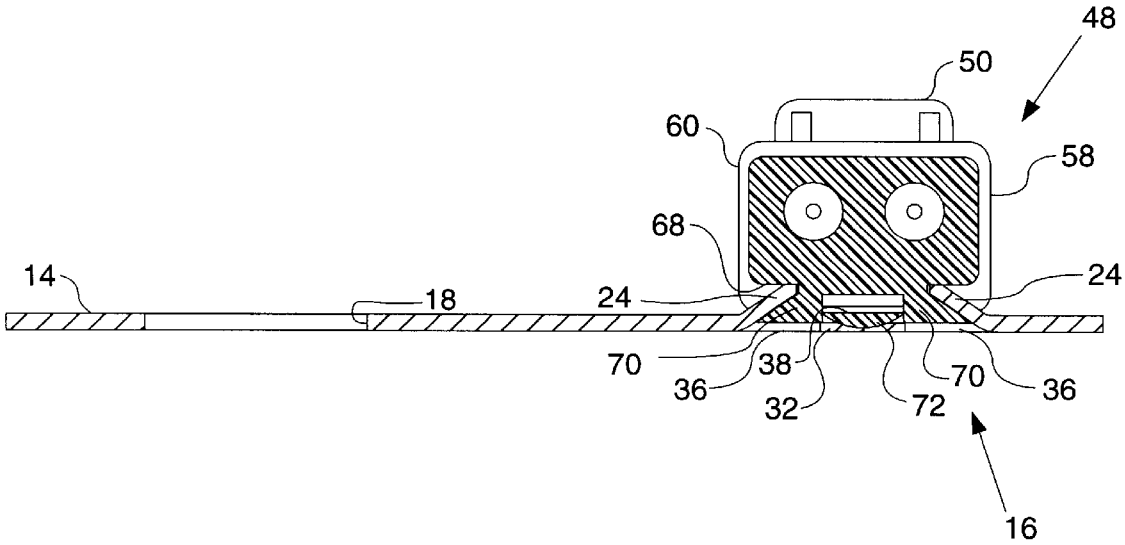
FIG. 2 is a diagrammatic section view of the connector assembly taken along lines 2—2 of FIG. 1.
Figure 3:
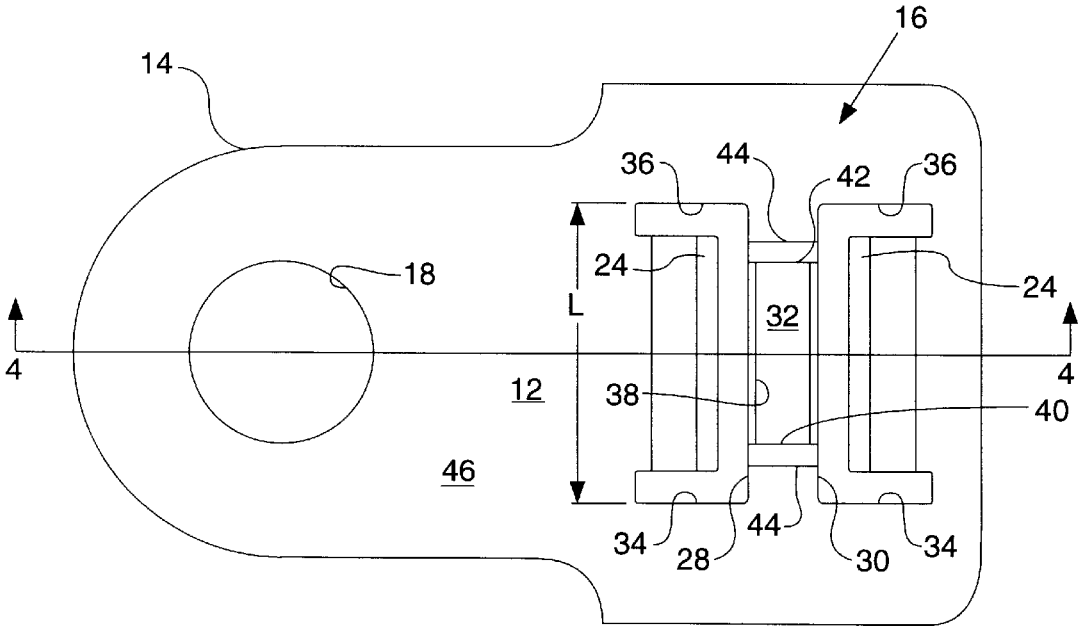
FIG. 3 is a diagrammatic top view of the base member of the connector assembly.
Figure 4:
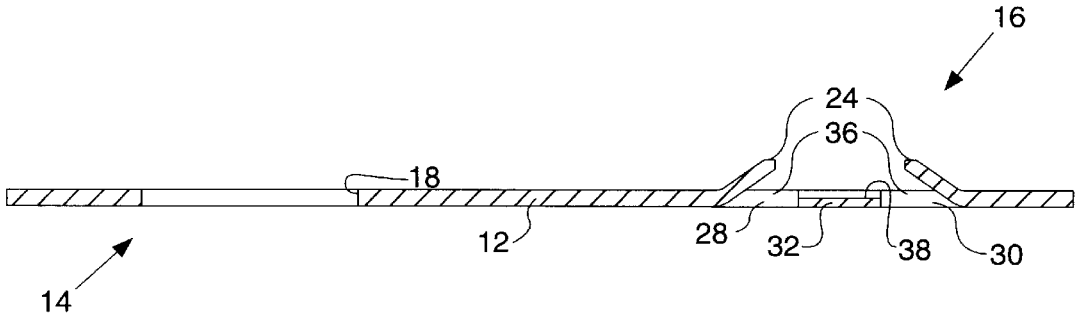
FIG. 4 is a diagrammatic section view of the connector assembly taken along lines 4—4 of FIG. 3.
Figure 5:
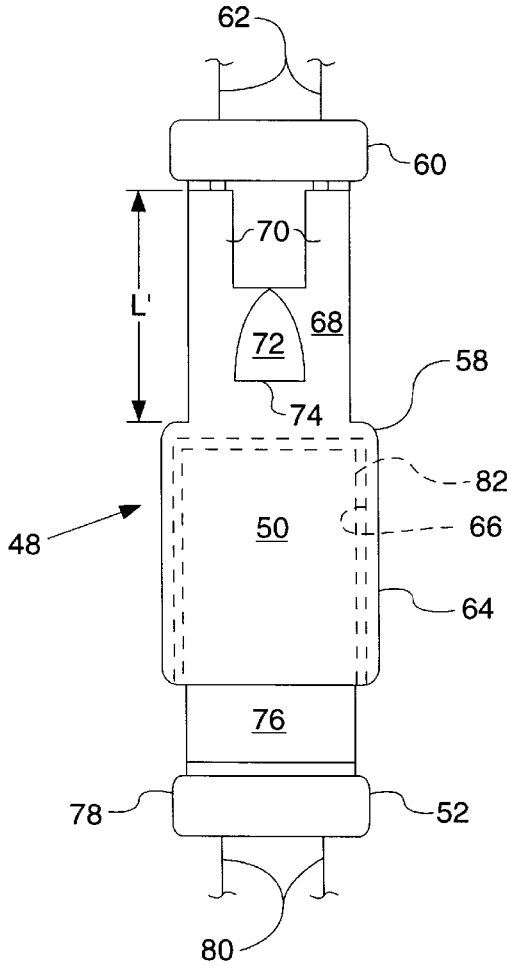
FIG. 5 is a diagrammatic bottom view of the clip assembly of the connector assembly as viewed in FIG. 2.

A clip assembly 48 comprising a pair of clip members 50 and 52 are interposed between a pair of wires in a manner to be described hereinafter. The first clip member 50 is defined by a housing 58 having a first end portion 60 that receives a pair of first wire portions 62. The first clip member has a second end portion 64 that defines a receptacle 66. A lower surface 68 of the housing 58 defines a pair of spaced apart, outwardly extending flanges 70. The flanges 70 are configured to extend from the lower surface 68 of the housing at angles that are complimentary to the angles of the flanges 24 defined by the base member 12. The lateral spacing of the flanges 70 defined by the first clip member 50 is such that they are only slightly narrower than the spacing of the flanges 24 defined by the base member. Being so configured, the flanges 70 are positioned just inside of the flanges 24 and are in contact therewith to establish a "dovetail" connection between the two components as can be seen in FIG. 2. The flanges 70 have a preselected length "L" that is slightly less than the pre-selected length of the openings 28 and 30 defined in the base member 12 so that the flanges 70 will be positioned between the endwalls 34 and 36 of the respective openings 28 and 30 when the first clip member 50 is connected to the base member 12. A tapered abutment member 72 is defined on the lower surface 68 of the housing 58 and defines a second abutment surface 74 on one end thereof. The tapered abutment member 72 is adapted for positioning within the groove 38 when the first clip member is connected to the base member with the first and second abutment surfaces 44 and 74 in engagement with one another.

A second clip member 76 has a first end portion 78 that is connected to a pair of wire portions 80 and a second end portion 82 that is adapted for insertion within the receptacle 66 defined by the first clip member 50. When engaged with one another, the first and second clip members 50 and 76 complete the communication of electrical current between the wire portions 62 and 80. The position of the respective clip members is secured together by a locking device (not shown) defined by the first clip member to engage the second clip member to hold the positions of the respective clip members in a well known manner.

Industrial Applicability

During the servicing of a machine, it is often necessary to remove one frame member from a machine. When this is done, it is necessary to remove any hoses or wiring that may be connected to that frame member. With the connector assembly 10 set forth above, the fastener 20 may be engaged with the appropriate tool and removed from engagement with the frame 22, leaving the first and second clip members 50 and 76 respectively, intact. Since the fastener is laterally spaced from the receiving portion 16 that mounts the clip members, this may be done quickly without interference between the components.

Alternatively, there may be an instance that requires the clip members 50 and 76 to be separated, leaving the base member 12 secured to the frame 22. In this instance, second clip member 76 may be removed from it's engagement within the receptacle 66 defined by the first clip member 50. The first clip member may then be urged along the direction of the groove 38. When this occurs, the interaction between the tapered end portion 40 or 42 of the groove and the tapered abutment member 72 will ease the first and second abutment surfaces 44 and 74 out of engagement with one another, allowing the flanges 70 to be lifted out of their positions from within the openings 28 and 30. As this occurs, the flanges 70 of the first clip member 50 are allowed to slide out of engagement with the flanges 24 defined by the base member 12, allowing the release of the first clip member from its engagement with the base member.

With a connector assembly 10 as set forth above, it can be seen that a clip assembly 48 may be secured to the frame 22 of a machine, for example, by a base member 12 in a manner wherein it may be easily removed when necessary in an expedient and versatile manner. In some instances, the base member 12 may be removed from engagement with the frame by removing the fastening member 20, thereby leaving the clip assembly 48 undisturbed. In other instances, the base member may be left engaged with the frame and the clip assembly may be easily disengaged with the base member without undue force, and re-engaged when the servicing has been complete.

Other aspects, objects and advantages of this invention can be obtained from a study of the drawings, the disclosure and the appended claims.

We claim:

1. A connector assembly, comprising: a base member having a mounting portion and a receiving portion laterally spaced from the mounting portion, said receiving portion having a pair of angled, outwardly extending flanges and a web portion located between said flanges;

a groove having a tapered end portion on each end thereof is disposed in the web portion, said groove being positioned between the flanges and said tapered end portions extending outwardly relative to the flanges;

a first clip member having a housing, a pair of outwardly extending flanges, and a tapered abutment member, said housing having a lower surface, said outwardly extending flanges and tapered abutment member being rigidly connected to and extending from the lower surface, said lower surface of the first clip member being engageable with the base member, said outwardly extending flanges of the first clip member being in contact with the outwardly extending flanges of the base member and in a dovetailed relation thereto, and said tapered abutment member being disposed in engagement with one of the tapered end portions of the groove and releasably securing the position of the first clip member with respect to the base member.

2. The connector assembly as set forth in claim 1 wherein the base member is substantially planar in configuration.

3. The connector assembly as set forth in claim 1 wherein the mounting portion defines a bore that is adapted to receive a fastener to secure the base member to a frame, said bore being spaced from the receiving portion a distance sufficient to permit access to the fastener without requiring a removal of the first clip member from the base member.

4. The connector assembly as set forth in claim 1 wherein the first clip member has a first end portion connected to a first wire and a second end portion defining a receptacle.

5. The connector assembly as set forth in claim 4 including a second clip member, said second clip member having a first end portion connected to a second wire and a second end portion, said second end portion being engageable with the first clip member when the second end portion of the second clip is positioned within the receptacle of the first clip member, said first and second clip members conducting electrical current between the first and second wires.

6. The connector assembly as set forth in claim 1 wherein the contact surface between the tapered groove and the base member defining a first abutment surface.

7. The connector assembly as set forth in claim 6 wherein the tapered abutment member defined by the first clip member defines a second abutment surface, said second abutment surface being adapted for engagement with the first abutment surface to secure the first clip member within the groove defined by the base member.

8. The connector assembly as set forth in claim 1 wherein a pair of openings are defined in the base plate on opposite sides of the groove and are positioned subjacent each of the respective outwardly extending flanges defined by the base member, said openings having a preselected length.

9. The connector assembly as set forth in claim 8 wherein each of said outwardly extending flanges defined by the first clip member has a preselected length, said preselected length being substantially equal to the preselected length of the openings, said outwardly extending flanges of the clip member being engageable with an end wall of the openings and restraining the clip member from movement relative to the base member in a first direction, said engagement between the respective abutment surfaces of the groove and tapered abutment member restraining the first clip member from movement in a direction opposite that of said first direction.

* * * * *